United States Patent [19]

Ferbrache

[11] Patent Number: 4,691,840

[45] Date of Patent: Sep. 8, 1987

[54] LID LOCKING HANDLE FOR WASTE CONTAINER

[75] Inventor: Raymond B. Ferbrache, Winfield, Kans.

[73] Assignee: Gott Corporation, Winfield, Kans.

[21] Appl. No.: 929,488

[22] Filed: Nov. 12, 1986

[51] Int. Cl.[1] ..... B65D 45/00

[52] U.S. Cl. ..... 220/318; 220/1 T

[58] Field of Search ..... 220/1 T, 94 R, 318; 150/55

[56] References Cited

U.S. PATENT DOCUMENTS

| | | | |
|---|---|---|---|
| 3,416,701 | 12/1968 | Kramer et al. | 220/318 |
| 4,157,763 | 6/1979 | Bethejewski et al. | 220/94 R |
| 4,279,357 | 7/1981 | Robinson | 220/1 T |

OTHER PUBLICATIONS

"The Unbreakables", pp. 6–8, Tucker Housewares Catalog, 345 Control St., Leominister, MA 01453, Publ. 1985.

Catalog, p. 21, Rubbermaid Canada Inc., 2562 Stanfield Road, Mississauga, Ontario L4Y1S5, Publ. 1986.

*Primary Examiner*—George T. Hall

*Attorney, Agent, or Firm*—Richard O'Planick

[57] ABSTRACT

A trash container is disclosed comprising a receptacle base (4), a lid component (2), and a pair of handles (26) mounted to opposite sides of the receptacle. Each handle is pivotally mounted to a side of the receptacle base and provides integral eccentric cam lobes (38) which, as the handle is pivoted upward, rotate against the receptacle sidewalls into an upright locking position. Simultaneously, an outward projecting locking tooth from each handle penetrates a receptive groove in the container lid to secure the lid to the receptacle.

20 Claims, 6 Drawing Figures

LID LOCKING HANDLE FOR WASTE CONTAINER

BACKGROUND OF THE INVENTION

1. Field of the Invention

The subject invention relates to refuse containers in general, and in more particularly to refuse containers which include lid locking means for securely affixing a lid component to a receptacle base.

2. The Prior Art

Refuse containers having lockable lids are well-known in the art. Typically, such containers fall into two general classes. In one class, the waste containers comprise a receptacle body formed of resilient plastic material, and a lid component which is likewise formed of plastic. The lid component has an integral flange formed to project inwardly from a downward dependent rim to engage over a flange which circumscribes the outer rim of the receptacle base. A handle projection is usually integrally molded to project outward from the lid or base and is used for transporting the container.

The second general type of waste container which includes a lid lockable to a receptacle base, incorporates a wire formed handle pivotally mounted to one side. After the lid is situated upon the base receptacle, the wire handle is pivoted upward into a locking orientation over the receptacle lid. An offset step formed into the wire handle is conventionally designed to engage over the lid in interference-fit fashion. A portion of the wire handle extends upward above the receptacle lid and can thereafter be used to transport the container.

While the above set forth prior art embodiments work well and have been generally accepted in the industry, certain deficiencies inherent in each prevent them from achieving an entirely satisfactory waste container having a lockable lid. The first type of container, that which includes a resilient lid snapping over a receptacle rim, depends upon the receptacle base maintaining its shape for the lock to endure. Any deformation in either the lid or the base receptacle will cause the interference fit between the lid and the receptacle body to fail. In the second category of existing waste containers, those which include a wire handle for lid securement, the lock is likewise less than satisfactory. A wire handle is uncomfortable in transporting a heavily loaded waste container. Additionally, the wire handle is expensive to manufacture and, if deformed out of shape, can fail to achieve a satisfactory lock over the receptacle lid.

BRIEF SUMMARY OF THE PRESENT INVENTION

The subject invention teaches a trash container having a receptacle base and a lockable lid situatable thereupon. The receptacle base is of cylindrical shape, formed of suitable plastic material such as polyethylene. A lid locking handle, capable of being formed of commercially available plastic material, is provided having a cam actuatable lock. Each lid locking handle is pivotally mounted to a side of the receptacle base and provides integral eccentric cam lobes securely guided in rigid dual tracks built into the container side walls. As the lid locking handle is pivoted upward, the cam lobes rotate against the receptacle side walls within the integral tracks and into an upright locking position. The resilient receptacle base exerts a residual elastomeric force against the cam lobes which insures that the handle will remain in its locked, upright position.

Each lid locking handle further comprises an outward projecting locking tooth which penetrates a receptive continuous groove in the container lid as the handle pivots into an upright orientation. The tooth extension and groove in the container lid are structured so that the lock can effectively function with the lid positioned in any orientation upon the receptacle base within a full 360 degree range.

The aforementioned cam lock is overridden mechanically by a single hand operation, which pivots the handle away from the lid. Further, the handle is designed to provide an offset stepped mid segment which is spaced from the receptacle base and lid. Because of the offset, the handle can be used for lifting and dumping and provides a full grip diameter for convenient manual gripping.

Accordingly, it is an objective of the present invention to provide a trash container having integral means for securing the lid component to the receptacle base.

Yet a further objective of the present invention is to provide a trash container having lid locking means comprising relatively few component parts.

Still a further objective of the present invention is to provide a trash container having lid locking means actuatable by a single hand movement.

A further objective of the present invention is to provide a trash container having lid locking means which utilizes latent elastomeric forces within the receptable base for insuring a positive lock.

A further objective of the subject invention is to provide a trash container having lid locking means operable regardless of the lid component orientation upon the base receptacle throughout a 360 degree range.

Yet a further objective of the present invention is to provide a trash container having lid locking means functionally operable as a handle for transportation of the container.

A further objective is to provide a trash container having lid locking means which is economically and readily produced and assembled.

These and other objectives, which will be apparent to those skilled in the art, are achieved by a preferred embodiment which is described in detail below and which is illustrated by the accompanying drawings.

BRIEF DESCRIPTION OF THE ACCOMPANYING DRAWINGS

DETAILED DESCRIPTION OF THE PREFERRED EMBODIMENT

Figure 1:
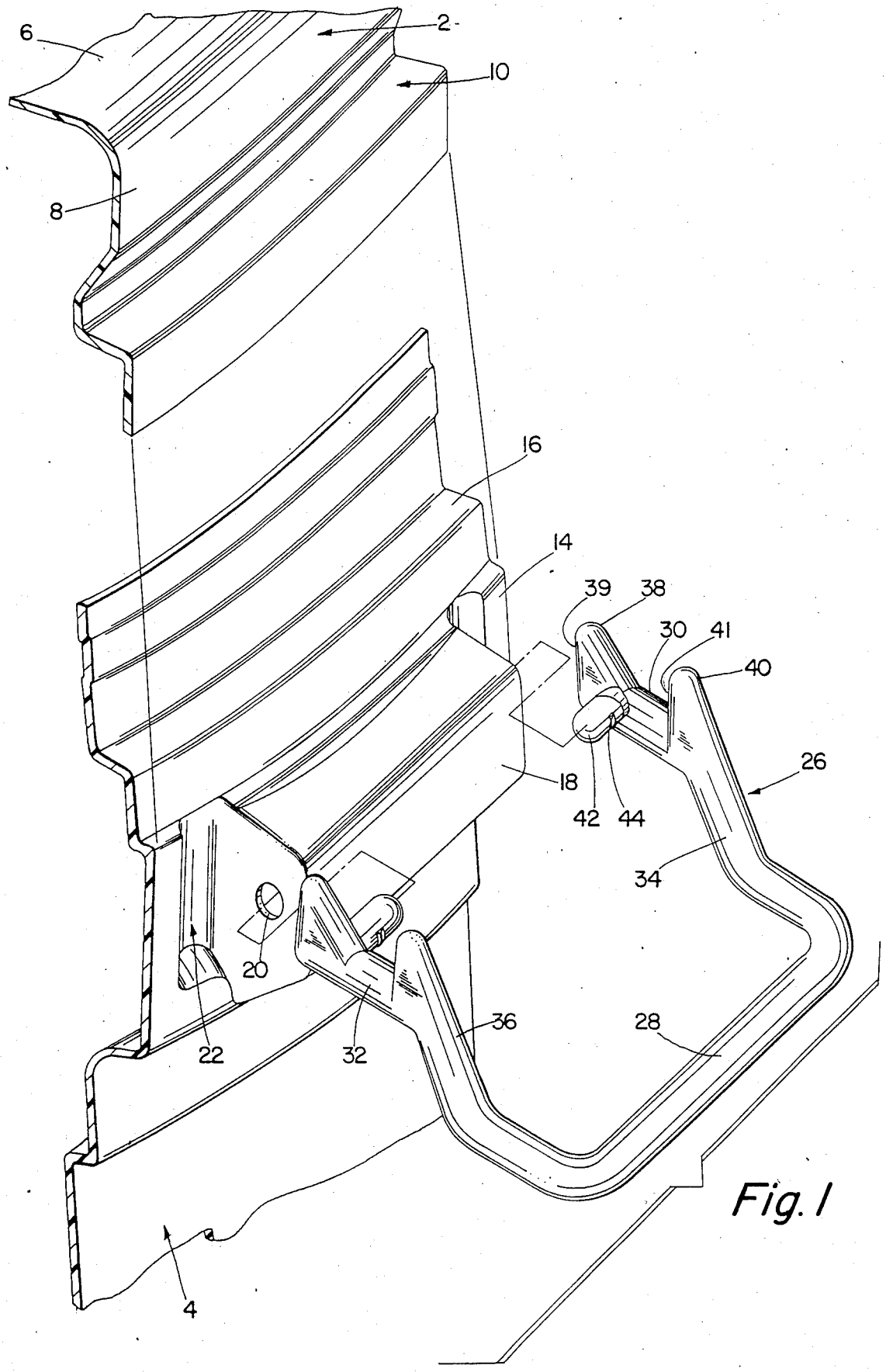
FIG. 1 is an exploded perspective view of the subject lid locking handle, together with a section of of the receptacle lid, and a section of the receptacle container to which the handle is affixed.
Figure 2:
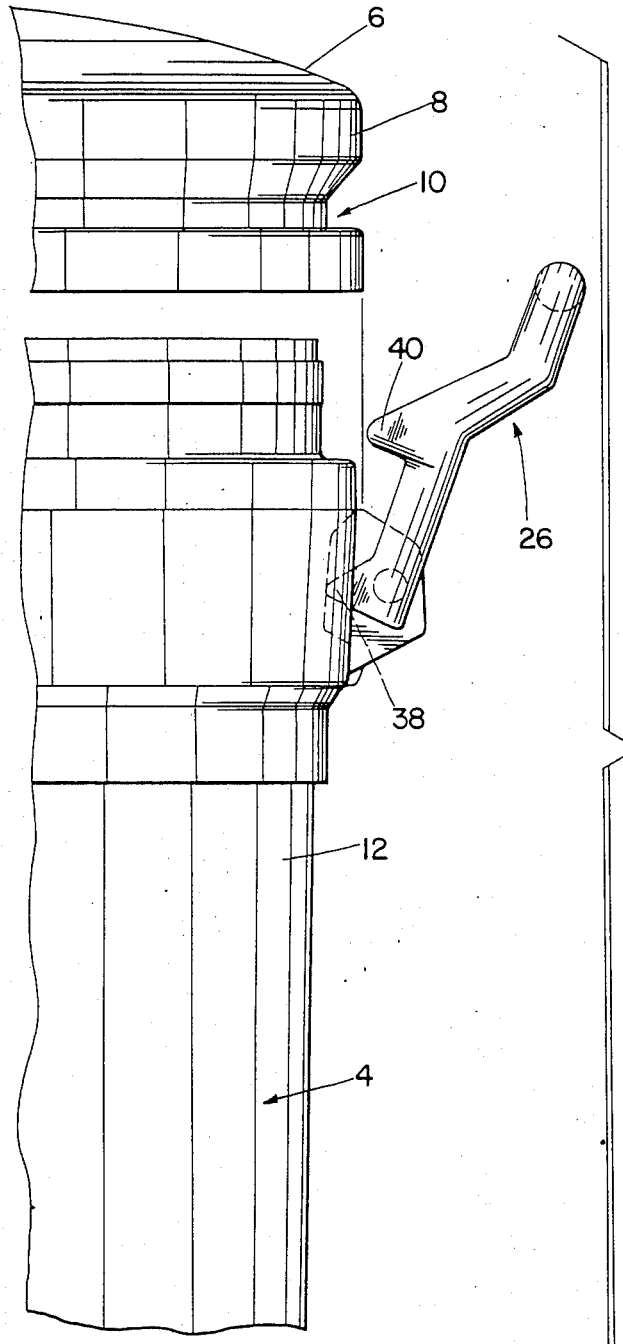
FIG. 2 is a partial side elevation view of the subject waste container illustrating the lid locking handle in the unlocked position.

Referring initially to FIGS. 1 and 2, the subject waste container is seen to comprise a lid component 2, a receptacle component 4, and a pair of handles 26 mounted to opposite sides of the receptacle 4. The lid 2 is circular in top plan view and has a generally domed top surface 6 which merges into a downturned peripheral flange 8. Midway down the vertical width of the peripheral flange 8 lies an annular groove 10 which extends the circumferential extent of lid flange 8.

The receptacle base 4 is cylindrical in shape, defined generally by cylindrical sides 12. A handle support buttress 14 extends outward from the plane of the sides 12, and is of generally elongate rectangular configuration. An inward step 16 extends along an upward longitudinal side of support buttress 14 and intersects with the cylindrical sides 12 of the receptacle base 4. Situated along the support buttress 14 is a mounting boss 18 of elongate rectangular construction. The mounting boss 18 is hollow and includes a pair of assembly apertures 20 situated in opposite ends thereof. Disposed adjacent to the opposite ends of the mounting boss 18 are vertical tracks 22 which are recessed within the sides 12 of the receptacle base 4. Each of the tracks 22 is of an upright rectangular shape, the size of which being prescribed in greater detail below.

Figure 4:
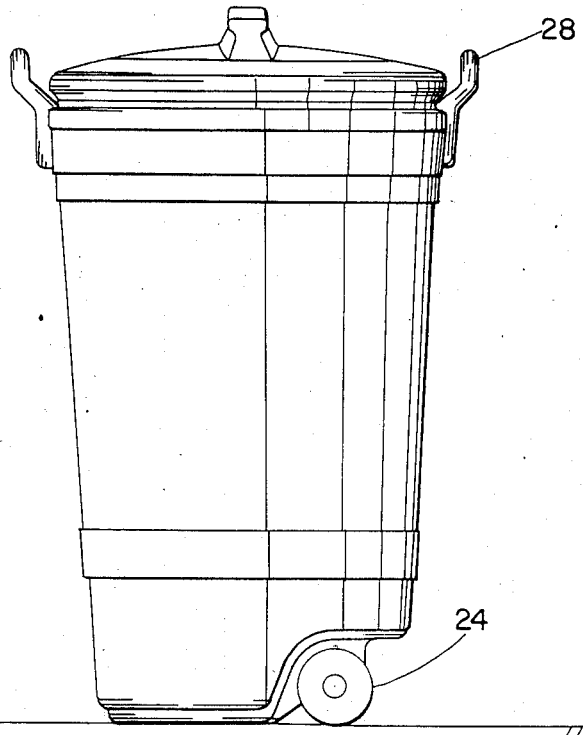
FIG. 4 is a full side elevation view of the subject waste container illustrating both of the lid locking handles in the locked configuration.

It will be appreciated from FIG. 4 that the receptacle is mounted to a wheel and axle assembly 24 which enables the waste container to be transported along the ground. The wheels assembly 24 are attached to a transverse axle (not shown) which is supported by an undersurface of the receptacle base 4 in a manner conventional to wheeled containers sold in the industry.

Referring to FIG. 1, each of the handles 26 (one of which being shown) is of a generally U-shaped configuration. Each handle 26 comprises a bight portion 28 from which elongate arm segments 30, 32 extend. The arm segments 30, 32 adjoin the bight portion 28 of each handle by way of intermediate segments 34, 36 respectively. The medial segments 34, 36 are offset from the plane of the remote arm segments 30, 32 such that the bight portion 28 of each handle 26 lies in a plane outward of the plane of segments 30, 32. The purpose for the offset of bight portion 28 is to enable the user of the waste container to conveniently grasp the portion 28 as a handle in transporting the container from one location to another. It will be appreciated from FIG. 1 that the segments 30, 32, 34, 36, and bight portion 28 are of generally tubular plastic construction, with each segment being of relatively large diameter. As a result, bight portion 28 is of full grip diameter for the comfort of the user as a handle.

Situated at distal ends of the arm segments 30, 32 are camming lobe projections 38. Each camming lobe projection is of a triangular side-profiled shape, with a remote planar side 39 of each lobe projection 38 facing the receptacle base 4 in general alignment with the vertical tracks 22 formed therein. It will be appreciated that the remote side 39 of each camming lobe 38 is flat and extends generally in a vertical direction. Continuing with regard to FIG. 1, a lid locking tooth projection 40 is likewise provided integral with each arm segment 30, 32 and is of a general triangular shape generally similar to the camming lobe projections 38. Each tooth projection 40 is spaced apart from its corresponding lobe projection 38, and extends parallel thereto. Further, each tooth projection 40 provides an inwardmost flat surface 41 extending parallel with lobe surface 39 which rotates with the handle into a horizontal orientation in a manner described below.

As seen from FIG. 1, proximate to the distal end of each arm segment 30, 32 of the handles 26 is an inward directed stud projection 42 of cylindrical shape. The projection 42 has a retention flange 44 which extends in an annular direction partially around each stud projection 42, spaced a distance from the arm segments 30, 32.

Figure 5:
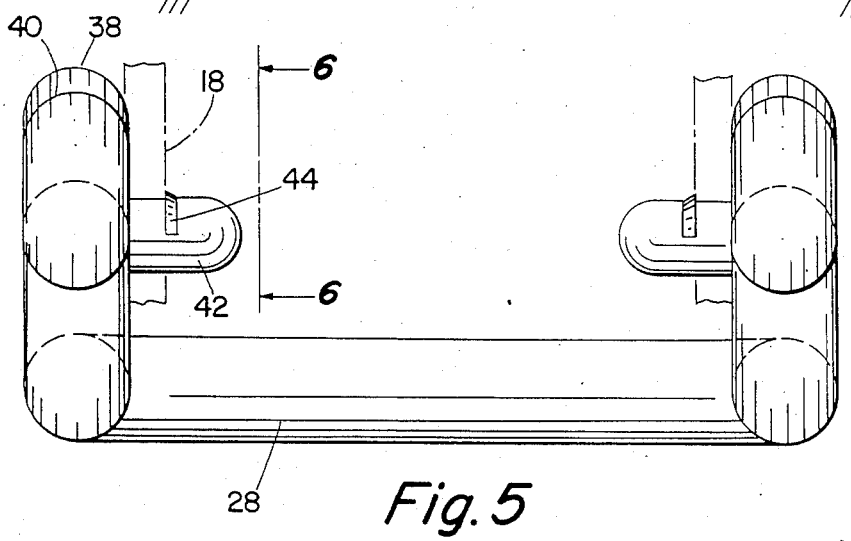
FIG. 5 is an end elevational view of one of the lid locking handles comprising the subject invention.
Figure 6:
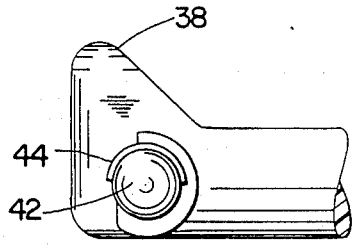
FIG. 6 is a side elevational view of a distal portion of the lid locking handle depicted in FIG. 5 taken along the line 6—6.

Assembly of the subject waste container proceeds as follows. It will be appreciated from FIGS. 1 and 2 that the lid component 2 fits over the top of the base receptacle 4 until the downward edge of the peripheral flange 10 of the lid 2 rests upon the step portion 16 of the base receptacle 4. Since the lid and base receptacle are both of circular cross section, the lid can be oriented upon the base receptacle in any orientation throughout a 360 degree range. Each of the handle components 26 (one of which being shown) is secured to the handle mounting boss 18 of the receptacle base 4 by insertion of the pivot stud projections 42 of the handle through the apertures 20 in opposite ends of the mounting boss 18. As a stud projection 42 penetrates through the aperture 20, the annular retention flange 44, which tapers outwards, engages against an internal side of the end mounting boss 18 to retain the handle in a pivotal relationship to the mounting boss 18. Refer to FIGS. 5 and 6, which illustrate the assembly of the handles to the base receptacle 4.

Figure 3:
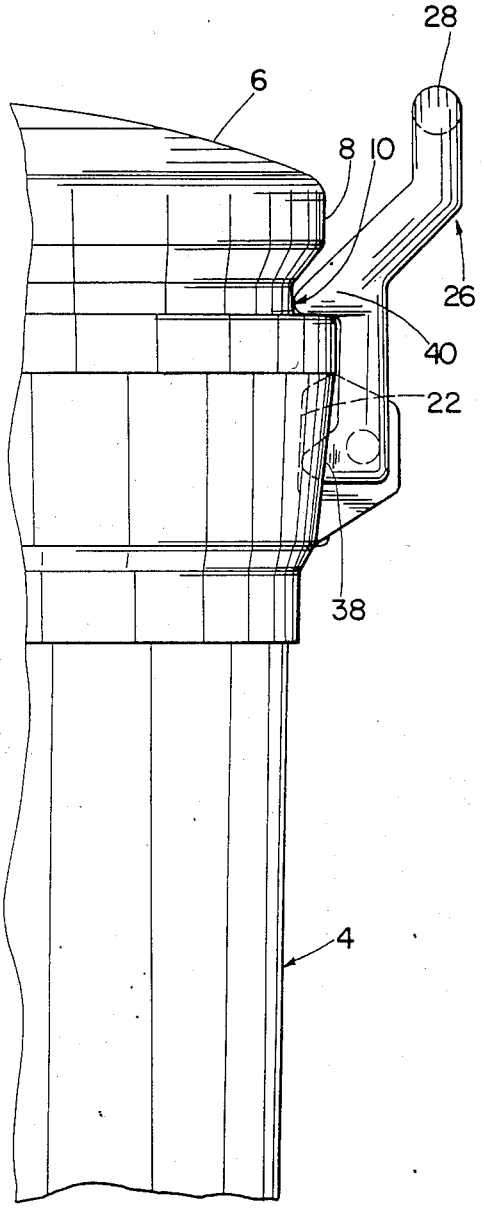
FIG. 3 is a partial side elevation view of the subject waste container illustrating the lid locking handle in the locked position.

FIGS. 2 and 3 show the subject lid locking handles assembled to the receptacle base, and illustrate in sequence the operation of the handles in securing the lid component. With reference to FIG. 2, the handle 26 is pivoted away from the receptacle base 4 so as to enable the lid component to slide over the top of the receptacle. The surfaces 39 of camming lobe projections 38 of the handle 26 at this point approach parallel with the track recesses within the base 4. Subsequent to the positionment of the lid component 2 upon the base 4, seated against the horizontal step 16 thereof, the lid locking handles can be pivoted upward into an upright position as illustrated in FIG. 3.

It will be appreciated that during the pivotal upward movement of the handles 26, the radiused lobe projections 38 impress against the receptacle base recesses 22, as the tooth projections 40 of the handles protrude into the annular groove 10 of the lid component 2. In the upright locked position illustrated in FIG. 3, the elongate caming lobe projection 38 has deformed the resilient waste receptacle 4 inward at the track recesses 22 such that latent resilient forces within the elastomeric base 4 exert an outward force against each lobe projection 38. This residual elastomeric force frictionally secures the camming lobe projections 38 into the horizontal orientation depicted in FIG. 3, and resist any inadvertent or unintended pivotal movement of the handle 26 out of its locking relationship with the lid.

It will be appreciated further that release of the handle can simply be achieved by manual pivotal movement of the handle away from the receptacle lid, overcoming the frictional lock between the base receptacle 4 and the camming projections 38. A single handed release of each of the handles 26 is facilitated by the subject handle configuration.

As described previously, the base receptacle 4 and lid component 2 are of circular cross sectional shape, whereby the lid component 2 can be situated upon the base in any position within a 360 degree range. It will be noted from FIGS. 1, 2, and 3, that the subject locking handles 26 effectively function to lock the lid to the base component regardless of the orientation of the lid throughout its 360 degree range of operation.

With reference to FIG. 4, it will be noted that the bight portion 28 of the locking handles extends upward from the receptacle lid in prominent fashion. Further, because of the offset between the bight and the arm segments 30, 32, and medial segments 30, 36 (see FIG. 1), the bight portion 28 can operate as a handle for transporting the waste receptacle. Moreover, because dual handles are provided, on opposite sides of the container, the bight portions 28 can be used for lifting the waste receptacle upward without disturbing the lid lock. As further shown in FIG. 4, the handles can be used to tip the waste container against the wheeled assembly 27, whereby the container can be rolled along the ground in convenient fashion.

While the above describes the preferred embodiment of the subject invention, the present invention is not to be so constrained. Other embodiments, which will be apparent to one skilled in the art, and which utilize the teachings herein set forth, are intended to be within the scope and spirit of the subject invention.

I claim:

1. A refuse container comprising:

a receptacle body having vertical side walls and a central cavity extending downwardly there between;

a lid having a downturned peripheral rim receivable over a top end of said receptacle body, said lid having peripherally located detent means;

at least one lid locking handle having an inward end pivotally coupled to said receptacle body side walls and an outward free end; said handle having camming handle locking projection means and lid locking projection means for respective engagement against said receptacle body side walls and said lid detent means as said handle free end is pivoted toward said receptacle body.

2. A refuse container according to claim 1, wherein a portion of said handle free end extends above a top surface of said lid.

3. A refuse container according to claim 1, wherein said handle locking projection means comprising at least one eccentric camming lobe disposed to rotate over said receptacle body side walls into a fixed, locked position.

4. A refuse container according to claim 3, wherein said receptacle body is formed of elastomeric plastics material deformable inwardly under influence of said camming lobe.

5. A refuse container according to claim 4, wherein said camming lobe residing in a vertically extending recess formed within said receptacle body.

6. A refuse container according to claim 5, wherein said lid locking projection means comprising a tooth extension projecting parallel and spaced apart from said camming lobe.

7. A refuse container according to claim 6, wherein said lid detent means being located in said lid peripheral rim.

8. A refuse container according to claim 7, wherein said lid detent means comprising a continuous groove in said lid peripheral rim adapted to receive said handle tooth extension therein.

9. A refuse container according to claim 8, wherein said lid and said receptacle body being of circular horizontal cross section whereby said lid is situatable upon said receptacle body throughout a 360 degree range of orientation.

10. A refuse container according to claim 1, wherein said lid locking handle having a generally U-shaped profile, comprising parallel arm segments extending from a central bight portion, with remote ends of said arm segments being pivotally coupled to said receptacle body.

11. A refuse container according to claim 10, wherein said handle locking projection means comprising at least one eccentric camming lobe disposed at a distal end of said handle and adapted to rotate over said receptacle body into a fixed locked position.

12. A refuse container according to claim 11, wherein said receptacle body being composed of resilient elastomeric plastics material deformable inwardly under influence of said camming lobe whereby said receptable body exerting a residual outwardly directed frictional lock against said camming lobe in said fixed locked position.

13. A refuse container comprising:

a receptacle body having vertical side walls and a central cavity extending downwardly therebetween;

a lid having a downturned peripheral lid receivable over said top end of said receptacle body and said lid having peripherally located detent means;

at least one generally U-shaped handle comprising two parallel arm segments extending from a central bight portion, with distal ends of said handle arm segments pivotally coupled to said receptacle body, whereby said bight portion swinging toward said receptacle body into a locking position and away from said receptacle body into a release position; at least one said handle arm segment having spaced apart handle locking means and lid locking projection means to respectively engage said receptacle side walls and said lid detent means as said handle bight portion is pivoted toward said receptacle body.

14. A refuse container according to claim 13, wherein said handle bight portion extending above the top surface of said lid in said locking position.

15. A refuse container according to claim 14, wherein said lid and said receptacle body being of substantially circular in horizontal cross section.

16. A refuse container according to claim 15, wherein said lid detent means comprising a continuous groove formed in said lid peripheral rim.

17. A refuse container according to claim 16, wherein said lid locking projection means comprising a tooth projection profiled for receipt into said lid rim groove.

18. A refuse container according to claim 13, wherein said handle locking means comprising an eccentric camming lobe disposed to rotate over said receptacle as said handle bight portion is rotated into said locking position.

19. A refuse container according to claim 18, wherein said receptacle body being composed of resilient plastic materials deformable inwardly as said camming lobe rotates thereover, whereby said receptacle body exerting outwardly directed resilient forces against said camming lobe in said locked position.

20. A refuse container, according to claim 19, wherein said camming lobe residing in a vertical track recess formed in said receptacle body.

* * * * *